US009868615B2

(12) United States Patent
Helvilä et al.

(10) Patent No.: US 9,868,615 B2
(45) Date of Patent: Jan. 16, 2018

(54) METHOD AND SYSTEM FOR DETECTING A STALL CONDITION IN AN ELEVATOR

(71) Applicants: Jari Helvilä, Hyvinää (FI); Sakari Korvenranta, Hyvinkaa (FI); Petter Martonen, Shanghai (CN); Petteri Valjus, Helsinki (FI); Jukka Laitinen, Vantaa (FI); Lauri Stolt, Helsinki (FI)

(72) Inventors: Jari Helvilä, Hyvinää (FI); Sakari Korvenranta, Hyvinkaa (FI); Petter Martonen, Shanghai (CN); Petteri Valjus, Helsinki (FI); Jukka Laitinen, Vantaa (FI); Lauri Stolt, Helsinki (FI)

(73) Assignee: Kone Corporation, Helsinki (FI)

( * ) Notice: Subject to any disclaimer, the term of this patent is extended or adjusted under 35 U.S.C. 154(b) by 489 days.

(21) Appl. No.: 14/514,615

(22) Filed: Oct. 15, 2014

(65) Prior Publication Data

US 2015/0114761 A1 Apr. 30, 2015

(30) Foreign Application Priority Data

Oct. 24, 2013 (EP) ..... 13190064

(51) Int. Cl.

*B66B 1/34* (2006.01)
*B66B 5/12* (2006.01)
*B66B 5/02* (2006.01)

(52) U.S. Cl.

CPC ..... *B66B 5/125* (2013.01); *B66B 5/02* (2013.01)

(58) Field of Classification Search

CPC ..... B66B 5/125; B66B 5/02
USPC ..... 187/247, 293, 391, 393; 318/432, 434, 318/456, 458, 474; 49/26, 28; 361/23, 361/24, 31

See application file for complete search history.

(56) References Cited

U.S. PATENT DOCUMENTS 4,271,755 A * 6/1981 Kintgen ..... B65G 57/245 100/137
4,300,661 A * 11/1981 Hmelovsky ..... G05D 3/12 187/316

(Continued)

FOREIGN PATENT DOCUMENTS

CN 1030391 A 1/1989
CN 1688502 A 10/2005

(Continued)

OTHER PUBLICATIONS

European Search Report for European Patent Application No. EP 13190064 dated Feb. 3, 2014.
Chinese Office Action dated Aug. 24, 2017.

*Primary Examiner* — Anthony Salata
(74) *Attorney, Agent, or Firm* — Harness, Dickey & Pierce

(57) ABSTRACT

Stall condition in an elevator is potentially dangerous situation if it causes slack to the ropes of the elevator. In such situation a counterweight or elevator car does not move even if the hoisting machine is still operating. This situation may be prevented by stopping the elevator as early as possible after detecting such stall condition. The detection of the stall condition is based on monitoring the torque generated by the hoisting machine of the elevator. When rapid change in the torque is detected a stall condition is suspected. The elevator may be stopped or an alarm may be launched when the stall condition is suspected.

10 Claims, 3 Drawing Sheets

(56) References Cited

U.S. PATENT DOCUMENTS 4,701,684 A * 10/1987 Seidel ..... H02H 7/0851 318/282
4,832,158 A * 5/1989 Farrar ..... G05B 19/0421 187/316
4,833,380 A * 5/1989 Magee ..... B66B 5/02 187/288
4,851,982 A 7/1989 Tanahashi
5,162,711 A * 11/1992 Heckler ..... B66B 13/26 187/317
5,367,240 A * 11/1994 Schroder-Brumloop ..... H02H 7/1222 318/727
6,064,165 A * 5/2000 Boisvert ..... B60J 7/0573 318/465
6,573,678 B2 * 6/2003 Losey ..... G01M 3/12 307/10.1
6,806,664 B2 * 10/2004 Beishline ..... H02H 7/0851 318/280
6,870,334 B2 * 3/2005 Jurado ..... G05B 13/0265 318/282
7,005,884 B2 * 2/2006 Gunton ..... H02H 7/0851 324/537
7,148,652 B2 * 12/2006 Ghanemi ..... B66B 5/02 318/563
7,196,491 B2 * 3/2007 Mayhew ..... H02P 27/024 318/430
7,275,622 B2 * 10/2007 Hall ..... B66B 5/02 187/277
7,408,317 B2 * 8/2008 Payne ..... G05B 19/4062 318/638
7,921,969 B2 * 4/2011 Stolt ..... B66B 1/30 187/293
7,931,128 B2 * 4/2011 Sakai ..... B66B 1/308 187/250
8,172,042 B2 * 5/2012 Wesson ..... B66B 1/302 187/290
2003/0127289 A1 * 7/2003 Elgas ..... B60L 11/1803 187/224
2012/0279806 A1 * 11/2012 Webster ..... B66B 1/06 187/289

FOREIGN PATENT DOCUMENTS

CN 101330275 A 12/2008
CN 101679000 A 3/2010
CN 102131725 A 7/2011
CN 102351121 A 2/2012
EP 2186768 A1 5/2010
JP H06-144744 A 5/1994
JP 2009221009 A 10/2009
WO WO-2007/144456 A1 12/2007

* cited by examiner

METHOD AND SYSTEM FOR DETECTING A STALL CONDITION IN AN ELEVATOR

This application claims priority to European Patent Application No. EP13190064 filed on Oct. 24, 2013, the entire contents of which are incorporated herein by reference.

FIELD OF THE INVENTION

The invention relates to elevators and more particularly to detecting a stall condition of an elevator car or counterweight.

BACKGROUND OF THE INVENTION

Elevators comprising a traction sheave arranged to operate at least one, typically more, ropes to which an elevator car and a counterweight is attached are commonly used. The friction between ropes and traction sheave is critical in elevators. In normal operation conditions the friction between ropes and traction sheave is large enough so that when the motor operates the traction sheave the elevator moves up or down. The friction force is determined by a plurality of different factors, for example, the shape and texture of rope and traction sheave and weight of the elevator car and counterweight. Parameters of these factors are decided for various reasons, for example, energy efficiency and security requirements.

When the friction between the ropes and the traction sheave is high enough the ropes in the traction sheave do not slip even if the elevator car or the counterweight has stalled. Stalling can be caused, for example, by running failure where the elevator car or counterweight gets stuck in the elevator shaft. If the elevator car is going upwards and the downward going counterweight gets stuck there will be slack in the rope between the traction sheave and counterweight. The slack between the traction sheave and the counterweight, or the elevator car if the movement is in opposite direction, can cause inconveniences or even security risk. A further example of stalling is a situation wherein the counterweight, or an elevator car, is at the buffer but the hoisting machine is still operating.

Conventionally this problem has been solved by designing the system so that the friction is large enough to operate in normal conditions and in case of stalling it is not too high so that the rope will slip. This kind of designing sets limitation to the overall design of the elevator system and the additional mechanical movement causes inefficiency and unnecessary wear.

In an improved method the stalling situation is detected by monitoring the current required by the hoisting machine. For example, if the counterweight has stalled the gravity caused by the counterweight does not help in hoisting of the elevator car. Thus, the hoisting machine needs more electric current in order to maintain the upward movement of the elevator car. The stalling situation is detected if the current required by the hoisting machine exceeds a predetermined threshold value.

The drawback of the current threshold implementation is that the current does not exceed the threshold in all conditions. The current threshold must be above the highest allowable current and it is possible that it is not exceeded always when stalling has occurred.

SUMMARY

Stall condition in an elevator is potentially dangerous situation if it causes slack to the ropes of the elevator. In such situation a counterweight or elevator car does not move even if the hoisting machine is still operating. This situation may be prevented by stopping the elevator as early as possible after detecting such stall condition. The detection of the stall condition is based on monitoring the torque generated by the hoisting machine of the elevator. When rapid change in the torque is detected a stall condition is suspected. The elevator may be stopped or an alarm may be launched when the stall condition is suspected.

The present invention is applicable in all elevators having a traction sheave involving suspension means including common twisted cord steel ropes, high friction coated ropes, cogged belts and similar.

In an embodiment of the invention a method for detecting a stall condition in an elevator is disclosed. In the method torque used for hoisting said elevator is monitored. From the monitored torque the rate of change of said torque used is computed. A stall condition is detected when said computed rate of change exceeds a predetermined threshold value. In a further embodiment of the invention a computer program for to be executed in a controlling unit capable of instructing at least one elevator is disclosed.

In a further embodiment of the invention a system for detecting a stall condition in an elevator is detected. The system further comprises a control unit configured to measure the torque used for hoisting said elevator, wherein said control unit is configured to detect a stall condition when said torque changes rapidly. The rapid change may be detected with the method described above.

In a further embodiment of the invention a system described above is used for controlling at least one elevator. The system may be implemented to each of the elevators or at the group controlling level.

The benefit of the invention is that it is capable of detecting a stall condition in situations that are not covered by the conventional methods, such as torque or current threshold and thus solves the problems of prior art. A further benefit of the invention is that it does not typically require structural changes to the elevator. Typically the invention can be implemented using the existing equipment, however, when the elevator does not include the necessary components the needed components may be added without a need of further modifications to the existing system.

Thus, a benefit of the invention is that it improves the passenger security and is easy and cost efficient to implement. Furthermore, when the stalling condition controlling can be handled according to the present invention the designer has more freedom when choosing friction properties for ropes and traction sheave. This may allow better functionality and/or cheaper price of the whole elevator.

A further benefit of the invention is that it provides better passenger security also in configurations having suspension means that cannot slip. For example, when an elevator car operated with a cogged belt is going downwards, it is possible that the elevator car stalls. In such case when the hoisting machine continues operating the elevator slack between the traction sheave and the elevator car emerges. When the elevator car has stopped unexpectedly due to undesired defect it is possible that elevator car stops only temporarily. Thus, when the stall condition is released and there is slack in suspension means the car may fall freely. When the suspension means do not have slack any more an undesired impact may be caused. Such an impact is not only uncomfortable but may be also dangerous. The benefit of the invention is that it detects such an situation rapidly so that the elevator may be stopped without causing risks or inconveniences to passengers in the elevator car. Correspondingly a stall condition of the counterweight may cause risks or inconveniences.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

Figure 1:
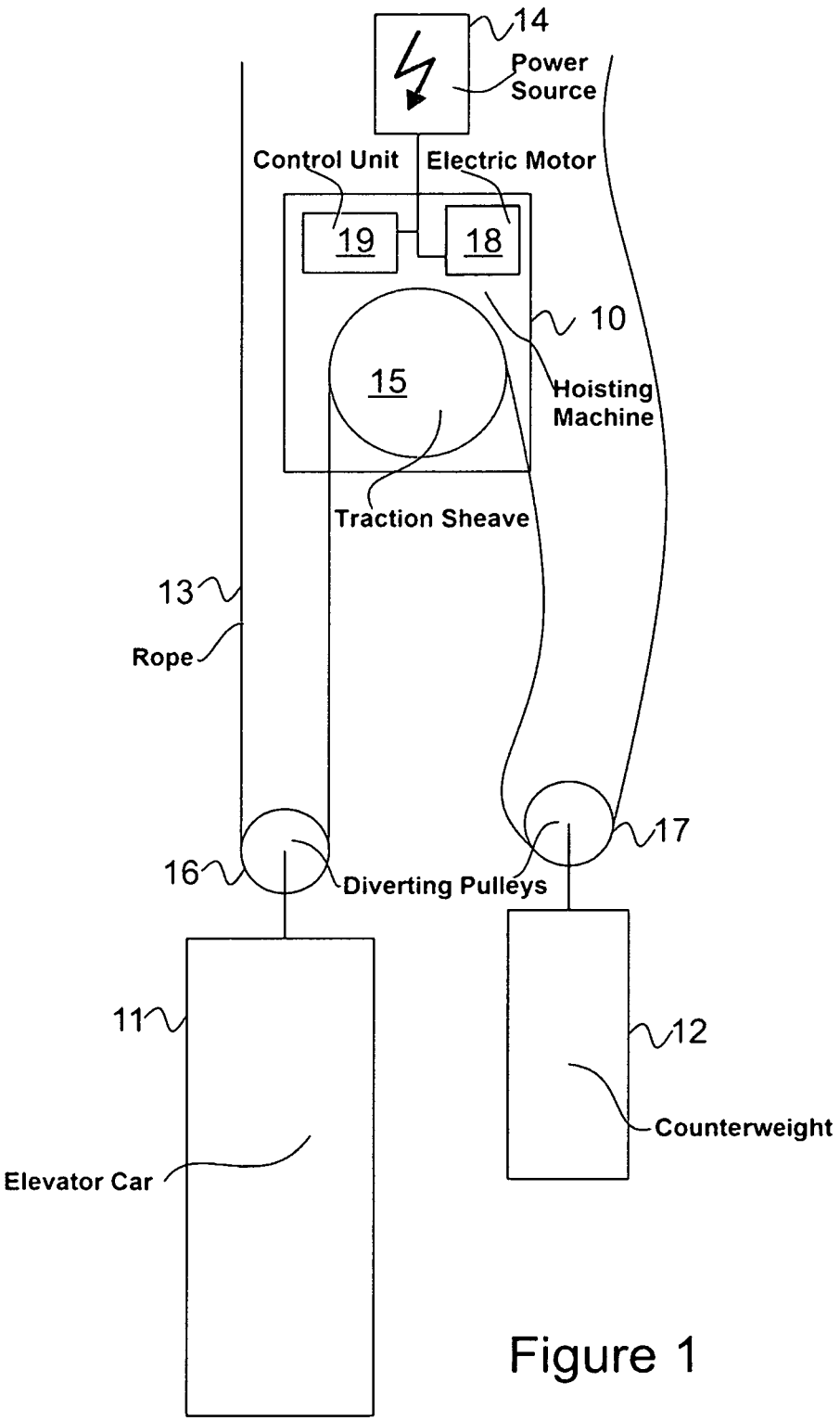
FIG. 1 is a block diagram of an example embodiment of the present invention is disclosed.

In FIG. 1 a block diagram of an example embodiment according to the present invention is disclosed. In the embodiment a hoisting machine 10 is configured to operate an elevator comprising an elevator car 11 and a counterweight 12. The elevator car 11 and the counterweight 12 are coupled with a rope 13 that is arranged to be operated by the hoisting machine 10. The ropes are coupled to the elevator car 11 and the counterweight 12 by diverting pulleys 16, 17. The ends of the rope 13 are coupled to the elevator shaft so that the elevator can be operated. For example, the ropes may be coupled to support structures of the hoisting machine so that the traction sheave 15 can be operated by a hoisting machine. A person skilled in the art understands that there are also other configurations for the elevator ropings.

In FIG. 1 the hoisting machine 10 is coupled to the power source 14 so that the electric motor 18 is able to transform the electricity into torque for moving the elevator car and the counterweight through the traction sheave 15. The hoisting machine further comprises a control unit 19 that is connected to the power source such that it can measure the power consumption of the electric motor 18.

In the example of FIG. 1 the elevator car 11 is going upwards and the counterweight 12 downwards. For some reason the counterweight 12 get jammed to the shaft so that it stops moving downwards. Immediately there will be slack in the rope 13 on the side of the counterweight 12. Because the counterweight 12 does not help the upward movement of the elevator car 11 the electric motor 15 must do all the work. Thus, it needs more power from the power source 14.

The control unit 19 measures the electric current continuously. When it detects a rapid change in the electric current from power source 14 to electric motor 14 it determines that the counterweight is not moving anymore. After the determination the control unit 19 makes the emergency stop of the elevator in order to prevent further slack. Further actions, such as automatic emergency call, may be applied.

In the embodiment explained with referral to FIG. 1 the rapid change of torque was disclosed. The torque was derived from the electric current. Thus, detecting rapid change in the electric current is an example of measuring the change of the torque applied at that moment of time. Also other means of detecting the rapid change may be applied.

Figure 2:
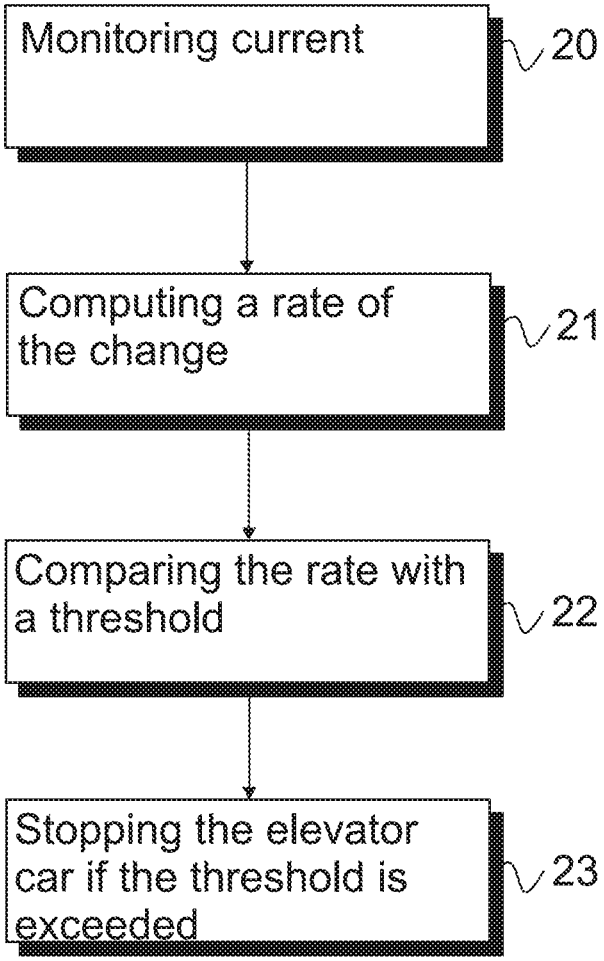
FIG. 2 is a flowchart of an example embodiment of the present invention.

In FIG. 2 a method according of an example embodiment is disclosed. In the method the use of the electric current is monitored, step 20. Modern elevators may be configured to monitor a plurality of different functions for various purposes. For the present invention it is interesting to measure the torque used for hoisting and it can be derived from the electric current used for hoisting. The actual measurement process is known to a person skilled in the art of signal processing and depending on the application it may be necessary process the measured signal in order to make correct conclusion from the measurement result. For example, the processing may include filtering undesired, typically high frequency components from the torque indicating signal. During monitoring the rate of change of used torque is continuously computed, step 21. For example, the change may be measured during a predetermined time interval. Such interval may be chosen on an application basis, however, a person skilled in the art understands that the time interval must be relatively small period of time as elevators travel fast and the slack should be minimized. The computed value is continuously compared with a predetermined threshold, step 22. The threshold is also chosen on an application basis so that the ordinary movement of the elevator does not trigger the condition. If the threshold is exceeded the elevator may be stopped, step 23. Instead of stopping it is possible to launch an alarm, however, when slack in the ropes is suspected it is typical to stop the elevator for the sake of the passenger security. Typically the alarm is launched always after an emergency stop.

If the elevator does not comprise a measurement device it is possible to install an additional measurement device. The measurement device may comprise all functionality discussed. Thus, when the additional device detects rapid change it is capable of stopping the elevator and launching an alarm.

Figure 3:
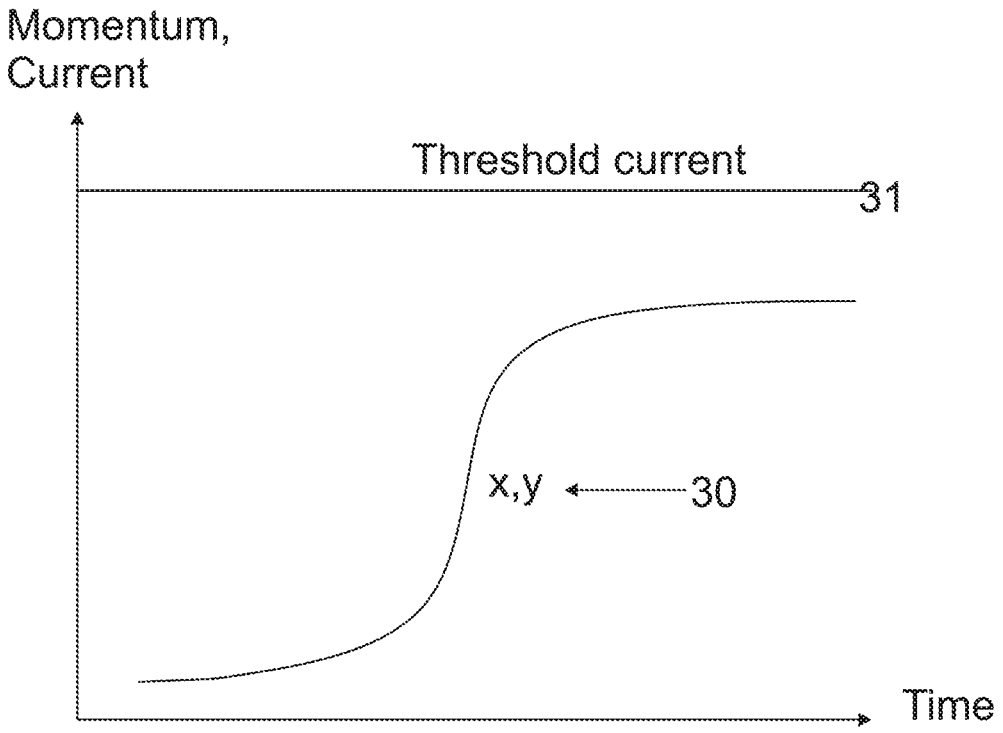
FIG. 3 is an illustration of a rapid change according to the example of FIG. 2.

In FIG. 3 a diagram disclosing a rapid change is illustrated. In figure at the moment of time x pointed by the arrow 30 a rapid change has occurred as the value of y changes rapidly as a function of x. Thus the derivate, $f'(x)$ has a high value and hoisting must be stopped. For the sake of the clarity in FIG. 3 a threshold current 31 according to prior art is disclosed. The threshold current mechanism may be used together with the present invention, however, in the example of FIG. 3 the threshold current is not exceeded. Thus, the conventional method would not detect the possible stall condition of the example. This can be caused, for example, when an empty elevator car is hoisted. Thus, the current needed is smaller compared to the situation where full elevator car is hoisted and thus, the threshold current is not exceeded.

The above mentioned method may be implemented as computer software which is executed in a computing device able to communicate with a measurement device for detecting rapid change in torque used for hoisting and to stop the elevator when such change is detected. When the software is executed in a computing device it is configured to perform the above described inventive method. The software is embodied on a computer readable medium so that it can be provided to the computing device.

As stated above, the components of the exemplary embodiments can include computer readable medium or memories for holding instructions programmed according to the teachings of the present inventions and for holding data structures, tables, records, and/or other data described herein. Computer readable medium can include any suitable medium that participates in providing instructions to a processor for execution. Common forms of computer-readable media can include, for example, a floppy disk, a flexible disk, hard disk, magnetic tape, any other suitable magnetic medium, a CD-ROM, CD±R, CD±RW, DVD, DVD-RAM, DVD±RW, DVD±R, HD DVD, HD DVD-R, HD DVD-RW, HD DVD-RAM, Blu-ray Disc, any other suitable optical medium, a RAM, a PROM, an EPROM, a FLASH-EPROM, any other suitable memory chip or cartridge, a carrier wave or any other suitable medium from which a computer can read.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method for detecting a stall condition in an elevator, the method comprising:

monitoring torque of a hoisting machine used for hoisting said elevator, the monitoring including measuring electric current input in or output from a motor of the hoisting machine;

computing a rate of change of said torque;

detecting a stall condition in response to said computed rate of change exceeding a threshold value, the threshold value indicating said torque, changes rapidly; and generating a response based on detecting said stall condition.

2. The method according to claim 1, wherein the generating the response includes stopping said elevator.

3. The method according to claim 1, wherein the generating the response includes launching an alarm.

4. A non-transitory computer readable medium storing code that, when executed by a data processor, configures the data processor to, monitor torque of a hoisting machine used for hoisting an elevator, the monitoring including measuring electric current input in or output from a motor of the hoisting machine;

compute a rate of change of said torque;

detect a stall condition in response to said computed rate of change exceeding a threshold value, the threshold value indicating said torque changes rapidly; and generate a response based on detecting said stall condition.

5. A system for detecting a stall condition in a hoisting machine of an elevator, the system comprising:

a measuring device configured to measure electric current input in or output from a motor of the hoisting machine; and at least one processor configured to, monitor torque of the hoisting machine based on the electric current, compute a rate of change of said torque, detect a stall condition in response to said computed rate of change exceeding a threshold value, the threshold value indicating said torque changes rapidly, and generate a response based on detecting said stall condition.

6. The system according to claim 5, wherein the at least one processor is configured to generate the response such that the response includes stopping the elevator.

7. The system according to claim 5, wherein the at least one processor is configured to generate the response such that the response includes launching an alarm.

8. The system according to claim 5, wherein said at least one processor is configured to monitor a plurality of elevators based on a plurality of electric currents associated with respective ones of the plurality of elevators.

9. An elevator including the system of claim 5.

10. An elevator group including the system of claim 5, said elevator group including a plurality of elevators.

* * * * *